United States Patent [19]

Kuhn

[11] 4,327,876

[45] May 4, 1982

[54] CONTINUOUS CENTER-WINDING APPARATUS AND METHOD

[75] Inventor: William T. Kuhn, 4 Heather Ct., Upper Saddle River, N.J. 07458

[73] Assignees: William T. Kuhn; Paul F. Rose; Thomas H. Rose

[21] Appl. No.: 193,015

[22] Filed: Oct. 2, 1980

[51] Int. Cl.[3] ..... B65H 19/20

[52] U.S. Cl. ..... 242/56 A

[58] Field of Search ..... 242/56 A, 56 R, 64, 242/67.1 R, 65

[56] References Cited

U.S. PATENT DOCUMENTS

| | | | |
|---|---|---|---|
| 1,040,188 | 10/1912 | Gray | 242/56 A |
| 2,339,151 | 1/1944 | Cohn | 26/55 |
| 2,378,024 | 6/1945 | MacChesney | 242/74 |
| 2,391,547 | 12/1945 | Cohn | 26/55 |
| 2,427,943 | 9/1947 | Butterworth | 271/2.3 |
| 2,589,344 | 3/1952 | Cohn | 26/18.5 |
| 2,589,345 | 3/1952 | Cohn | 26/18.5 |
| 2,602,314 | 7/1952 | Cohn | 68/6 |
| 2,622,817 | 12/1952 | Cohn | 242/65 |
| 2,653,812 | 9/1953 | Cohn | 270/79 |
| 2,700,543 | 1/1955 | Cohn | 270/79 |
| 2,718,362 | 9/1955 | Piperoux | 242/56 R |
| 2,728,532 | 12/1955 | Bower | 242/56 R |
| 2,736,098 | 2/1956 | Cohn | 33/130 |
| 2,736,508 | 2/1956 | Longbo | 242/56 A |
| 2,749,115 | 6/1956 | Cohn | 270/79 |
| 2,774,328 | 12/1956 | Rose | 118/44 |
| 2,944,317 | 7/1960 | Cohn | 26/18.5 |
| 3,345,009 | 10/1967 | Rockstrom | 242/56 A |
| 3,369,766 | 2/1968 | Herman | 242/56 A |
| 3,409,243 | 11/1968 | Wasserlein | 242/64 |
| 3,443,769 | 5/1969 | Breacker | 242/56 R |
| 3,472,462 | 10/1969 | Young | 242/56 A |
| 3,501,104 | 3/1970 | Hellemans | 242/56 R |
| 3,529,785 | 9/1970 | Mistele | 242/56 A |
| 3,794,255 | 2/1979 | Harmon | 242/56 R |
| 3,799,469 | 3/1974 | Oga | 242/56 A |
| 3,848,824 | 11/1974 | Schijndel | 242/56 A |
| 3,871,595 | 3/1975 | Smolderon | 242/56 A |
| 4,111,377 | 9/1978 | Tetro | 242/56 R |
| 4,139,163 | 2/1979 | Tabel | 242/56 R |

*Primary Examiner*—Edward J. McCarthy

*Attorney, Agent, or Firm*—Lerner, David, Littenberg & Samuel

[57] ABSTRACT

Apparatus and method for continuously center-winding a web into a plurality of rolls utilize a pair of cutting blades which cooperate to sever the web after it has been wound into a roll. One of the cutting blades assumes a cutting position at the inception of a winding operation. The other cutting blade is moved into a cutting position at the termination of the winding operation.

28 Claims, 3 Drawing Figures

CONTINUOUS CENTER-WINDING APPARATUS AND METHOD

FIELD OF THE INVENTION

The present invention relates to a center-winding method and apparatus and, more particularly, to such a method and apparatus which are adapted to continuously wind a web into a plurality of rolls.

BACKGROUND OF THE INVENTION

There are basically two types of techniques for winding a web into a roll. These are a surface-winding technique, in which a driving force is applied to an outer surface of a rolled web, and a center-winding technique, in which a core is rotated to wind a web into a roll on the core. In many instances, the center-winding technique is preferred over the surface-winding technique. For example, the surface-winding technique encounters problems in properly driving the rolled web when the web has a printed, textured or slippery surface.

In the past, center-winding apparatus have been disclosed which are capable of continuously winding a web into a plurality of rolls (see, for instance, Young U.S. Pat. No. 3,472,462 and Hellemans U.S. Pat. No. 3,501,104). Such continuous center-winding apparatus have employed a single knife to sever the web between winding operations. The use of a single knife is disadvantageous because the web must be tensioned so that the knife can cut it. Some materials have an insufficient tensile strength to withstand the tension required to cut them using a single knife. Other materials are too heavy to tension to the extent necessary to perform a successful cutting operation using a single knife.

Breacker et al. U.S. Pat. No. 3,443,769 and Smolderen U.S. Pat. No. 3,871,595 disclose center-winding apparatus in which a pair of knives are employed to cut a web. However, both of the apparatus require the repositioning of a rolled web at or near the termination of a winding operation. Also, both of the knives of each apparatus must be pivoted into cutting positions at the termination of a winding operation. Such repositioning of the rolled web and pivoting of the knives are time consuming. Thus, an operator performing an unscheduled cutting operation, for safety reasons or otherwise, might not be able to accomplish such an operation as quickly and efficiently as desired.

SUMMARY OF THE INVENTION

Many of the problems and disadvantages of the prior art devices discussed above are overcome by the apparatus and method of the present invention which employ a pair of cooperating cutting devices to sever a center-wound web. The scissoring effect achieved by using a pair of cutting devices eliminates the need to tension the web before it is cut. Thus, the apparatus and method of the present invention may be successfully employed in connection with materials which are too heavy to be tensioned to the extent necessary to permit cutting by a single cutting device, as well as materials which do not have a sufficiently high tensile strength to withstand the tensioning required to permit cutting by a single cutting device. Because the apparatus and method of the present invention can be used in connection with more types of materials than the prior art apparatus and methods, the apparatus and method of the present invention are more versatile than the prior art apparatus and methods.

Another aspect of the apparatus and method of the present invention involves indexing a turret such that a winding core carried by the turret is moved from a web-receiving location to a web-winding location immediately after a winding operation is commenced at the web-receiving location. As soon as the winding core has moved from the web-receiving location to the web-winding location, an upper cutting device is moved from a non-cutting position to a cutting position between the web-receiving location and the web-winding location. Such movement of the winding core and the upper cutting device prior to the termination of a winding operation allows an operator to perform an unscheduled cutting operation quickly and efficiently at any time after the winding operation has been commenced simply by actuating a lower cutting device.

The upper cutting device can be locked in its cutting position to inhibit displacement during the cutting operation, thereby contributing to the success thereof. If the upper cutting device is not locked in its cutting position, the lower cutting device can be automatically disabled so as to prevent the cutting operation from occurring.

BRIEF DESCRIPTION OF THE DRAWINGS

For a more complete understanding of the present invention, reference may be had to the following description of an exemplary embodiment taken in conjunction with the accompanying figures of the drawings, in which.

DESCRIPTION OF AN EXEMPLARY EMBODIMENT

Figure 1:
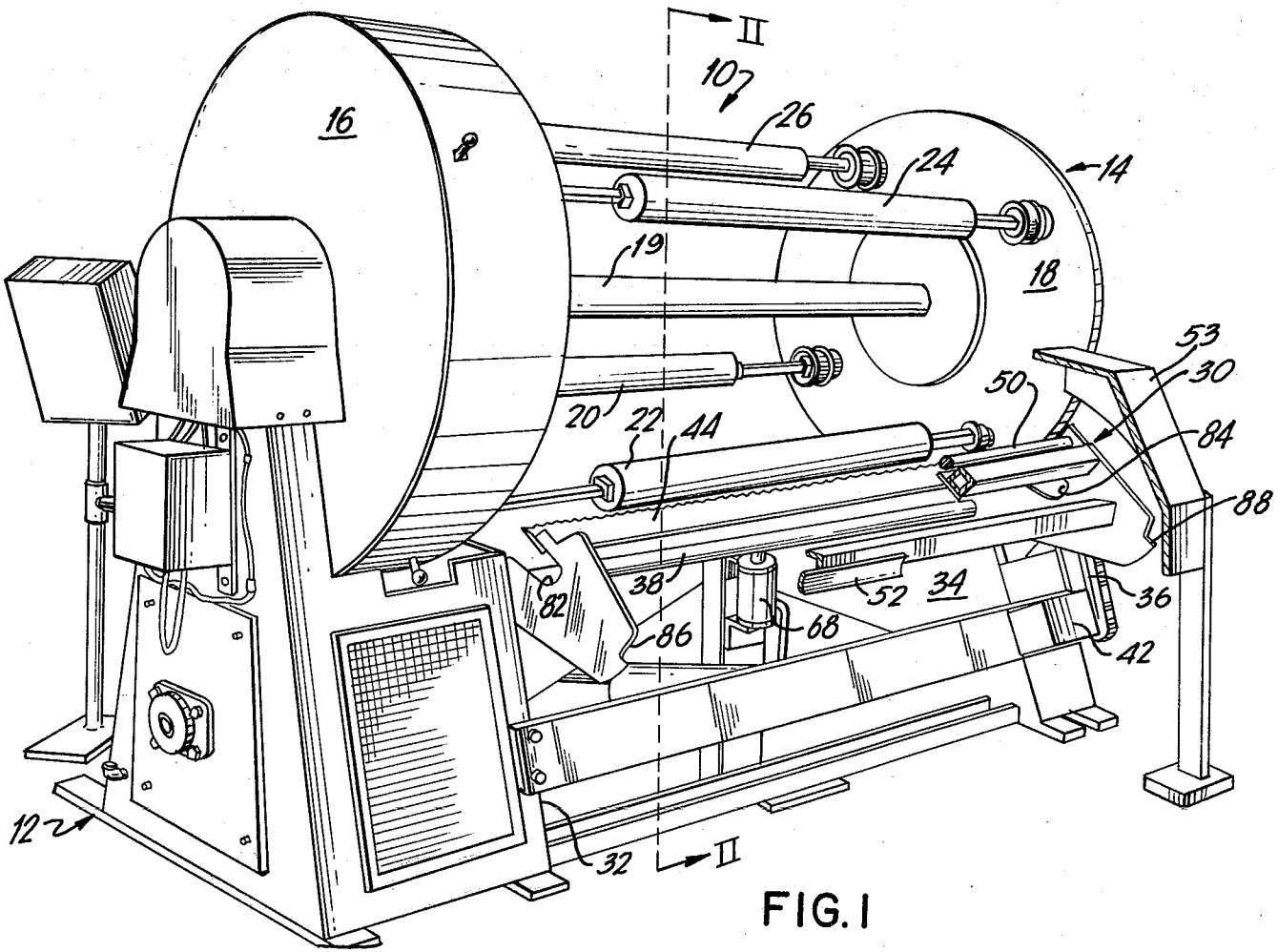
FIG. 1 is a perspective view of a continuous center-winding apparatus constructed in accordance with the present invention.
Figure 2:
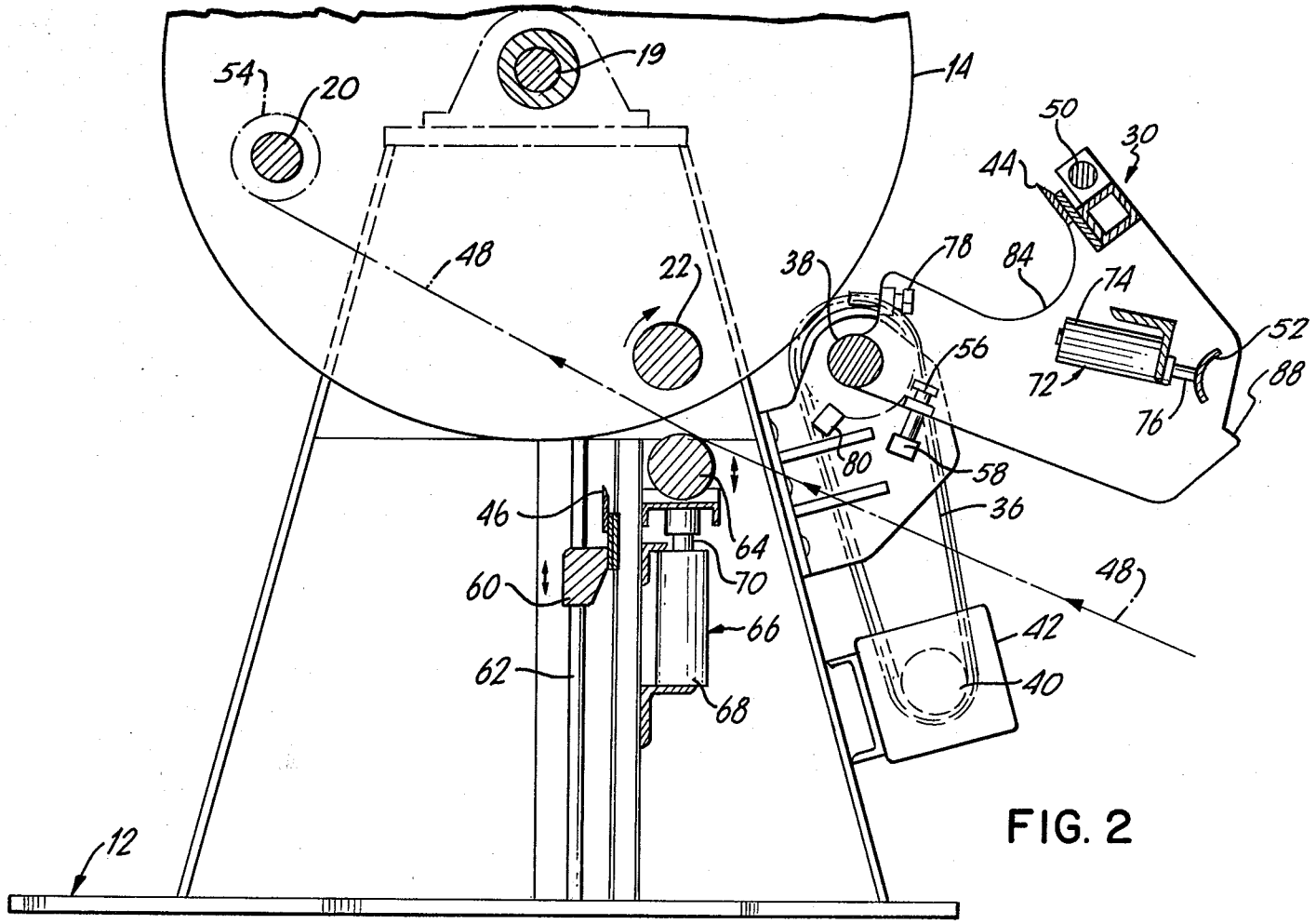
FIG. 2 is a cross-sectional view, taken along line II—II of FIG. 1 and looking in the direction of the arrows, of the apparatus shown in FIG. 1, the apparatus being in a non-cutting stage of operation.
Figure 3:
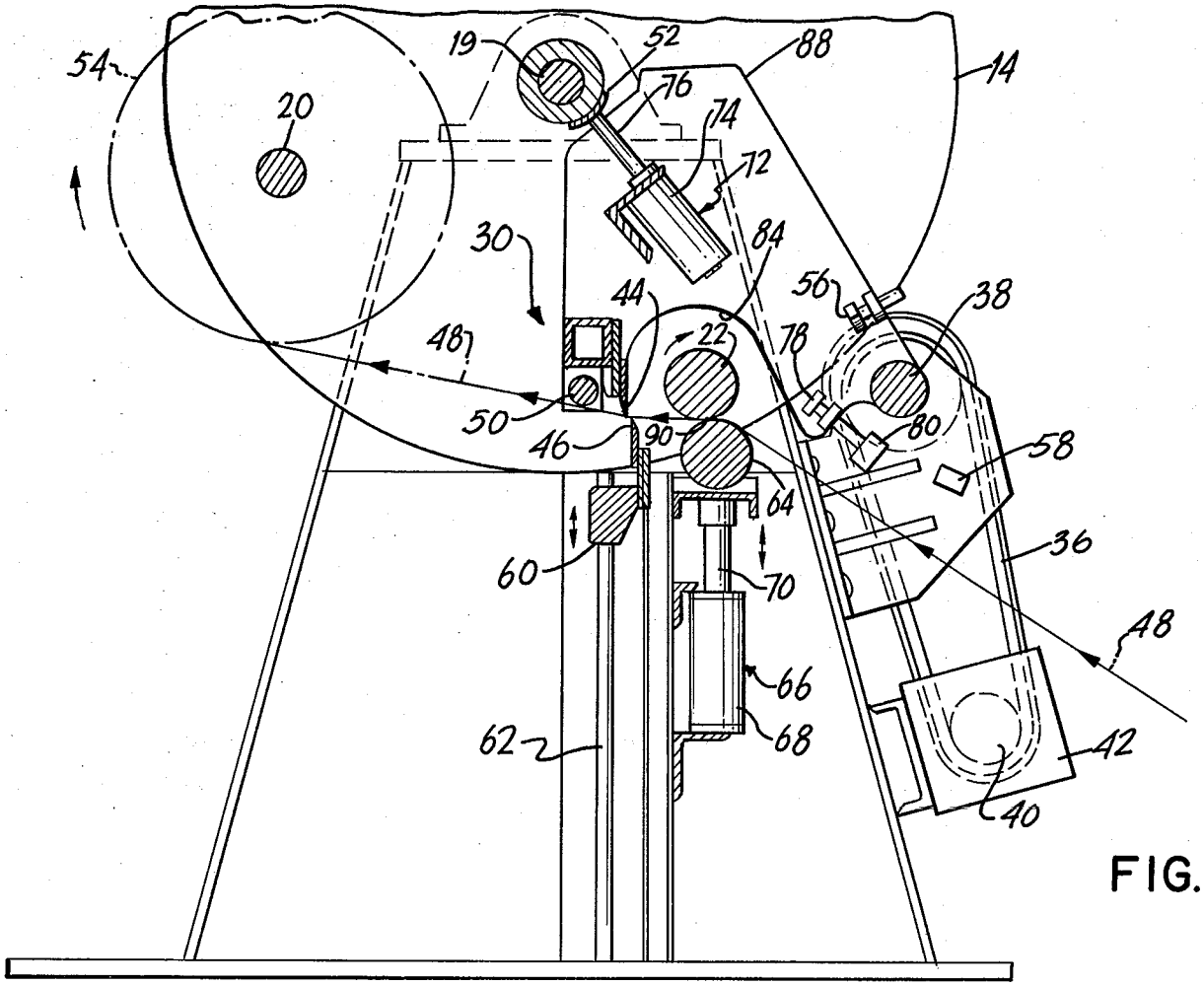
FIG. 3 is a cross-sectional view, taken along the line II—II of FIG. 1 and looking in the direction of the arrows, of the apparatus shown in FIG. 1, the apparatus being in a cutting stage of operation.

Referring to FIGS. 1-3, there is shown a continuous center-winding machine 10 including a fabricated frame 12 which rotatably supports a four position turret 14. The turret 14 includes a pair of circular end plates 16, 18 which are connected by a rotatable axle 19. Four individually rotatable core supports 20, 22, 24 and 26 also extend between the end plates 16, 18. The core supports 20, 22, 24 and 26 are adapted to receive various standard types of winding cores (not shown) onto which a web is to be wound, and, therefore, each of the core supports 20, 22, 24 and 26 defines a winding core location. Electromechanical means is provided for incrementally indexing the turret 14 in the direction of web travel. The incremental rotation of the turret 14 will be described in greater detail hereinafter.

An overhead knife subassembly 30 is pivotally mounted on sides 32, 34 of the frame 12. The overhead knife subassembly 30 is pivoted between a non-cutting position (see FIGS. 1 and 2) and a cutting position (see FIG. 3) by an endless chain 36 which links an axle 38 of the overhead knife subassembly 30 and an output shaft 40 of a rotary actuator 42 designed to drive the chain 36. The overhead knife subassembly 30 carries an upper knife blade 44 which cooperates with a lower knife blade 46 for cutting a web 48 (see FIGS. 2 and 3) being wound by the machine 10. The overhead knife subassembly 30 also carries a rotatable roller 50, which could be non-rotatable, and a clamp 52. A guard 53 totally encloses the overhead knife subassembly 30 when the overhead knife subassembly 30 is in its non-cutting position, thereby protecting individuals in the vicinity of the machine 10 during the pivoting of the overhead knife subassembly from its cutting position to its non-cutting position.

With reference to FIG. 2 in particular, the overhead knife subassembly 30 is shown in its non-cutting position in which the turret 14 can be indexed. The core support 20 has just been indexed from a web-receiving position, now occupied by the core support 22, to a web-winding location where the web 48 is being wound into a roll 54. The core support 22 is in the web-receiving location, having just been indexed from a first standby location, now occupied by the core support 24 (see FIG. 1). The core support 24 has just been indexed from a second standby location, now occupied by the core support 26 (see FIG. 1), to the first standby location. The core support 26 is in the second standby location, having just been indexed from the web-winding location, now occupied by the core support 20.

A bolt 56 carried from the overhead knife subassembly 30 cooperates with a stop 58 fixedly mounted on the frame 12 to delimit the non-cutting position of the overhead knife subassembly 30. The position of the bolt 56 relative to the overhead knife subassembly 30 is adjustable so that the non-cutting position of the overhead knife subassembly 30 may be varied.

The lower knife blade 46 is attached to a supporting bar 60 mounted for reciprocating movement in a pair of generally vertical tracks 62 (only one of which is shown), each of the tracks 62 being attached to a corresponding one of the sides 32, 34 of the frame 12. The tracks 62 are positioned between the web-receiving location occupied by the core support 22 and the web-winding location occupied by the core support 20. The lower knife blade 46 is in its non-cutting position.

The web 48 passes between the core support 22 at the web-receiving location and a roller 64 mounted for reciprocating movement toward and away from the web-receiving location by a pneumatically-operated ram 66. The ram 66 includes a cylinder 68 fixedly mounted to the frame 12 and a piston 70 slidably received in the cylinder 68.

The clamp 52 is reciprocated by a pair of pneumatically-operated rams 72 (only one of which is shown). Each of the rams 72 includes a cylinder 74 fixedly attached to the overhead knife subassembly 30 and a piston 76 slidably received in the cylinder 74.

As shown in FIG. 3, the overhead knife subassembly 30 has just been pivoted into its cutting position delimited by a bolt 78 carried by the overhead knife subassembly 30 and a stop 80 fixedly mounted on the frame 12. The position of the bolt 78 relative to the overhead knife subassembly 30 is adjustable so that the cutting position of the overhead knife subassembly 30 may be adjusted to achieve proper alignment of the upper knife blade 44 with the lower knife blade 46 and the web 48. The operation of the actuator 42 is controlled such that the overhead knife subassembly 30 is moved from its non-cutting position to its cutting position immediately after the core support 20 has been indexed from the web-receiving location to the web-winding location. In its cutting position, the upper knife blade 44 is situated directly above the web 48, with the pistons 76 of the rams 72 having been extended so as to move the clamp 52 into engagement with the axle 19 of the turret 14, thereby effectively locking the overhead knife subassembly 30 in its cutting position.

Cutouts 82, 84 (see FIG. 1) are provided in end plates 86, 88, respectively, (see FIG. 1) of the overhead knife subassembly 30 to receive the core support 22 arranged at the web-receiving location. The cutouts 82, 84 permit the end plates 86, 88 to actually straddle the core support 22.

The lower knife blade 46 is shown in its cutting position in which the lower knife blade 46 cooperates with the upper knife blade 44 to sever the web 48. The movement of the lower knife blade 46 is controlled such that the lower knife blade 46 cannot move from its non-cutting position to its cutting position until the clamp 52 engages the axle 19 of the turret 14.

Prior to being cut by the upper knife blade 44 and the lower knife blade 46, the web 48 is oriented by the roller 50, which is positioned downstream (as the web travels) from the upper knife blade 44 when the upper knife blade 44 is in its cutting position, and a nip 90, which is positioned upstream (as the web travels) from the upper knife blade 44 when the upper knife blade 44 is in its cutting position and formed by the engagement of the core support 22 by the roller 64. The roller 64 is moved into engagement with the core support 22 by the extension of the piston 70 from the cylinder 68 of the ram 66. More particularly, the roller 50 and the nip 90 cooperate to orient the web 48 such that the web 48 is generally perpendicular to the upper knife blade 44 and the lower knife blade 46 as the web 48 passes between the nip 90 and the roller 50. Such orientation of the web 48, which facilitates cutting of the web 48, is accomplished by the roller 50 and the nip 90, regardless of the diameter of the roll 54.

The upper knife blade 44 is arranged in its cutting position, in close proximity to the web 48, during substantially the entire period of time that the core support 20 is situated at the web-winding location. Thus, an operator can perform an unscheduled cutting operation quickly and efficiently at any time after the winding operation has been commenced simply by actuating the lower knife blade 46.

After the web 48 has been cut, the lower knife blade 46 continues its upward vertical movement for a distance sufficient to aid in the application of the incoming severed end of the web 48 to the core support 22, which has begun to rotate in a clockwise direction in order to wind the web 48 into another roll. The rotation of the core support 20 is immediately ceased.

Upon the attachment of the web 48 to the core support 22, the clamp 52 is disengaged from the axle 19 of the turret 14 by retracting the pistons 76 into the cylinders 74 of the rams 72. Until the clamp 52 disengages the axle 19 of the turret 14, the overhead knife subassembly 30 is prevented from being pivoted from its cutting position to its non-cutting position.

After the overhead knife subassembly 30 is pivoted back to its non-cutting position and the lower knife blade 46 is lowered back into its non-cutting position, the core support 20 is removed from the web-winding location of the turret 14 to permit the removal of the roll 54 from the core support 20. After a new winding core is installed on the core support 20 and the core support 20 is reinstalled on the turret 14 at the web-winding location, the turret 14 is indexed 90°, resulting in the positioning of the core support 22 at the web-winding location and the positioning of the core support 20 at the second standby location. Simultaneously, the core support 24 is moved to the web-receiving location, while the core support 26 moves to the first standby location. Immediately after such an indexing operation is accomplished, the overhead knife subassembly 30 is pivoted back into its cutting position in preparation for repetition of the previously described winding process.

It will be understood that the embodiment described herein is merely exemplary and that a person skilled in the art may make many variations and modifications without departing from the spirit and scope of the invention. For instance, core support removal and replacement may be accomplished at the second standby location, rather than at the web-winding location. All such modifications and variations are intended to be included within the scope of the invention as defined in the appended claims.

What is claimed is:

1. Apparatus for continuously center-winding a web into a plurality of rolls, comprising a rotatable turret having a plurality of winding core locations arranged generally parallel to an axis of rotation of said turret, said plurality of winding core locations including a first winding core location and a second winding core location; indexing means for indexing said turret such that winding cores carried by said turret are moved successively from said second winding core location to said first winding core location; first cutting means movable between a first position on a side of said second winding core location remote from said first winding core location and a second position between said first winding core location and said second winding core location; moving means for moving said first cutting means between said first position and said second position; second cutting means positioned between said first winding core location and said second winding core location so as to cooperate with said first cutting means to sever a web being wound onto a winding core arranged at said first winding core location when said first cutting means is in said second position; first controlling means for controlling said indexing means such that said indexing means moves a winding core from said second winding core location to said first winding core location immediately after a winding operation is commenced at said second winding core location; and second controlling means for controlling said moving means such that said moving means moves said first cutting means from said first position to said second position immediately after the movement of a winding core from said second winding core location to said first winding core location.

2. Apparatus according to claim 1, wherein said moving means pivots said first cutting means between said first and second positions.

3. Apparatus according to claim 2, wherein said second cutting means is reciprocable between a third position remote from said second position and a fourth position adjacent to said second position, said second cutting means cooperating with said first cutting means to sever a web being wound onto a winding core arranged at said first winding core location when said first cutting means is in said second position and said second cutting means is in said forth position.

4. Apparatus according to claim 3, wherein said first cutting means is positioned above a web to be severed and in close proximity thereto when said first cutting means is in said second position and said second cutting means is positioned below said first cutting means and below a web to be severed when said second cutting means is in said third position.

5. Apparatus according to claim 4, further comprising reciprocating means for reciprocating said second cutting means in a linear direction between said third and fourth positions.

6. Apparatus according to claim 5, wherein said first winding core location is positioned on one side of said axis of rotation of said turret and said second winding core location is positioned on an opposite side of said axis of rotation of said turret.

7. Apparatus according to claim 1 or 6, further comprising locking means for locking said first cutting means in said second position.

8. Apparatus according to claim 7, wherein said locking means includes a clamp movable with said first cutting means and engageable with an axle defining said axis of rotation of said turret and driving means for driving said clamp into and out of engagement with said axle.

9. Apparatus according to claim 8, further comprising third controlling means for controlling said driving means such that said clamp engages said axle when said first cutting means is in said second position and disabling means for disabling said second cutting means to prevent said second cutting means from cooperating with said first cutting means to sever a web being wound onto a winding core arranged at said first winding core location until said clamp engages said axle.

10. Apparatus according to claim 9, wherein said second controlling means controls said moving means such that said moving means cannot move said first cutting means from said second position to said first position unless said clamp is disengaged from said axle.

11. Apparatus according to claim 1, further comprising a frame, first mounting means for rotatably mounting said turret to said frame, and second mounting means for pivotally mounting said first cutting means to said frame, said second mounting means including a carriage positioned exteriorally of said turrent when said first cutting means is in said first position and interiorally of said turret when said first cutting means is in said second position.

12. Apparatus according to claim 11, wherein said carriage includes a first end plate pivotally attached to said frame adjacent one end of said turret and a second end plate pivotally attached to said frame adjacent to an opposite end of said turret, said first and second end plates including first and second receiving means, respectively, for receiving a core positioned at said second winding core location when said first cutting means is in said second position, whereby said first and second end plates straddle a core positioned at said second winding core location when said first cutting means is in said second position.

13. Apparatus according to claim 12, further comprising first and second adjustable stop members attached to said carriage and third and fourth stop members attached to said frame, said first stop member cooperating with said third stop member to define said first position and said second stop member cooperating with said forth stop member to define said second position.

14. Apparatus according to claim 11, further comprising orienting means for orienting the position of a web to be severed by said first and second cutting means such that a web to be severed is generally perpendicular to said first and second cutting means when said first and second cutting means are in said second and fourth positions, respectively.

15. Apparatus according to claim 14, wherein said orienting means includes a first roller rotatably mounted on said carriage, said first roller being positioned between said first winding core location and said first cutting means when said first cutting means is in said second position.

16. Apparatus according to claim 15, wherein said orienting means further includes a second roller movable into and out of engagement with a winding core located at said second winding core location.

17. A method for continuously center-winding a web into a plurality of rolls, comprising the steps of indexing a turret such that a winding core carried by said turret is moved to a first winding core location from a second winding core location immediately after a winding operation is commenced at said second winding core location; moving a first cutting means from a first position on a side of said second winding core location remote from said first winding core location to a second position between said first winding core location and said second winding core location immediately after the movement of said winding core from said second winding core location to said second winding core location; and moving a second cutting means into a cooperative relationship with said first cutting means when said first cutting means is in said second position, whereby said first and second cutting means cooperate to sever a web being wound onto said winding core at said first winding core location.

18. A method according to claim 17, wherein said first cutting means pivots from said first position to said second position.

19. A method according to claim 18, wherein said second cutting means reciprocates between a third position in which said second cutting means is positioned remote from said first cutting means and a fourth position in which said second cutting means is cooperatively positioned adjacent to said first cutting means to sever a web being wound onto said winding core at said first winding core location.

20. A method according to claim 19, wherein said first cutting means is positioned above a web to be severed and in close proximity thereto when said first cutting means is in said second position and said second cutting means is positioned below said first cutting means and below a web to be severed when said second cutting means is in said third position.

21. A method according to claim 20, wherein said first winding core location is positioned on one side of an axis of rotation of said turret and said second winding core location is positioned on an opposite side of said axis of rotation of said turret.

22. A method according to claim 17 or 21, further comprising the step of locking said first cutting means in said second position.

23. A method according to claim 22, wherein said locking step includes moving a clamp into engagement with an axle which defines said axis of rotation of said turret.

24. A method according to claim 23, further comprising the steps of controlling said clamp such that said clamp engages said axle only when said first cutting means is in said second position and disabling said second cutting means to prevent said second cutting means for cooperating with said first cutting means to sever a web being wound onto to said winding core at said first winding core location until said clamp engages said axle.

25. A method according to claim 24, further comprising the step of controlling said first cutting means such that said first cutting means cannot move from said second position to said first position unless said clamp is disengaged from said axle.

26. A method according to claim 25, further comprising the step of orienting the position of a web to be severed by said first and second cutting means such that a web to be severed is generally perpendicular to said first and second cutting means when said first and second cutting means are in said second and fourth positions, respectively.

27. A method according to claim 26, wherein said orienting step includes forming a nip upstream of said second position and providing a contact surface downstream of said second position.

28. A method according to claim 17, further comprising the steps of moving said first cutting means from said second position to said first position after a web being wound onto said winding core at said first winding core location is severed by said first and second cutting means and moving another winding core from said second winding core location to said first winding core location.

* * * * *